US007690756B2

(12) United States Patent
Takagi

(10) Patent No.: US 7,690,756 B2
(45) Date of Patent: Apr. 6, 2010

(54) INK-JET RECORDING APPARATUS AND CAP

(75) Inventor: Osamu Takagi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 461 days.

(21) Appl. No.: 11/693,928

(22) Filed: Mar. 30, 2007

(65) Prior Publication Data

US 2007/0257957 A1 Nov. 8, 2007

(30) Foreign Application Priority Data

Mar. 31, 2006 (JP) ..... 2006-097268

(51) Int. Cl.
*B41J 2/165* (2006.01)

(52) U.S. Cl. ..... 347/29; 347/32

(58) Field of Classification Search ..... 347/29, 347/30, 33, 32

See application file for complete search history.

(56) References Cited

U.S. PATENT DOCUMENTS

| | | | | |
|---|---|---|---|---|
| 4,684,963 | A * | 8/1987 | Naka | 347/29 |
| 5,146,243 | A * | 9/1992 | English et al. | 347/29 |
| 5,896,143 | A * | 4/1999 | Matsui et al. | 347/24 |
| 5,903,287 | A | 5/1999 | Ishikawa et al. | |
| 6,042,215 | A | 3/2000 | Imai | |
| 6,074,037 | A * | 6/2000 | Nakahara et al. | 347/29 |

FOREIGN PATENT DOCUMENTS

| | | |
|---|---|---|
| JP | H05-201007 A | 8/1993 |
| JP | H07-132607 A | 5/1995 |
| JP | H9-240012 A | 9/1997 |
| JP | H10-076679 A | 3/1998 |
| JP | 2002-172794 A | 6/2002 |
| JP | 2003-211682 A | 7/2003 |

OTHER PUBLICATIONS

Japan Patent Office; Notice of Reasons for Rejection in Japanese Patent Application No. 2006-0997268 (counterpart to the above-capitioned U.S. patent application) mailed Sep. 1, 2009.

* cited by examiner

*Primary Examiner*—Shih-wen Hsieh
(74) *Attorney, Agent, or Firm*—Baker Botts, LLP

(57) ABSTRACT

An ink-jet head includes nozzles which are configured to discharge ink droplets, an ink discharge surface which has ink discharge apertures of the nozzles formed therethrough, and a cap configured to cover the ink discharge surface. The cap includes a base member which opposes the ink discharge surface. The base member has a recess formed therein, and the recess has a communication hole formed therethrough. The cap also may include a damper film which is connected to the base member at an outer periphery of the recess and covers the recess, and a lip which is formed along an outer periphery of the base member and is configured to selectively contact the ink discharge surface. Moreover, the ink-jet head may include a cap holder which is connected to the cap and is configured to selectively apply a force to the cap toward the ink discharge surface.

10 Claims, 16 Drawing Sheets

INK-JET RECORDING APPARATUS AND CAP

BACKGROUND OF THE INVENTION

1. Field of the Invention

The present invention relates generally to an ink-jet recording apparatus for recording on a recording medium by dispensing ink droplets, and a cap for preventing ink from drying by covering an ink discharge surface in the ink-jet recording apparatus.

2. Description of Related Art

A known ink-jet recording apparatus, such as the ink-jet recording apparatus described in Japanese Publication No. JP-A-9-240012 and shown in FIG. 6, includes an ink discharge surface which is covered by contacting a cap body with a print head. The cap body has a recess formed therein, and when the air pressure within the recess of the cap body is about the same as the atmospheric pressure, a slit of the cap body is closed, which prevents the ink in the ink discharge surface from drying. When the air pressure in the recess of the cap body increases or decreases when the cap body contacts the print head, the slit is opened and the recess is in communication with the external air, such the air pressure in the recess becomes about equal to the atmospheric pressure. In this manner, menisci of the ink in the nozzles may not be by a variation of the air pressure in the recess.

Nevertheless, in the known ink-jet recording apparatus, to bring the cap into close contact with the ink discharge surface, a substantial amount of force is applied to the cap to press the cap against the ink discharge surface. Moreover, the force acting on the portion where the cap is in contact with the ink discharge surface when the cap is pressed against the ink discharge surface may vary.

SUMMARY OF THE INVENTION

Therefore a need has arisen for ink-jet recording apparatus which overcome these and other shortcomings of the related art. A technical advantage of the present invention is that a cap may be provided which prevents an ink menisci from being damaged when the air pressure within the cap varies.

According to an embodiment of the present invention, an ink-jet head comprises nozzles which are configured to discharge ink droplets, an ink discharge surface which has ink discharge apertures of the nozzles formed therethrough, and a cap configured to cover the ink discharge surface. The cap comprises a base member which opposes the ink discharge surface. The base member has a recess formed therein, and the recess has a communication hole formed therethrough. The cap also may comprise a damper film which is connected to the base member at an outer periphery of the recess and covers the recess, and a lip which is formed along an outer periphery of the base member and is configured to selectively contact the ink discharge surface. Moreover, the ink-jet head may comprise a cap holder which is connected to the cap and is configured to selectively apply a force to the cap toward the ink discharge surface.

According to another embodiment of the present invention, a cap comprises a base member which has a recess formed therein, and the recess has a communication hole formed therethrough. The cap also comprises a damper film which is connected to the base member at an outer periphery of the recess and covers the recess, and a lip which is formed along an outer periphery of the base member.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, the needs satisfied thereby, and the features and technical advantages thereof, reference now is made to the following descriptions taken in connection with the accompanying drawings.

DETAILED DESCRIPTION OF EMBODIMENTS

Embodiments of the present invention and their features and technical advantages may be understood by referring to FIGS. 1-16, like numerals being used for like corresponding portions in the various drawings.

Figure 1:
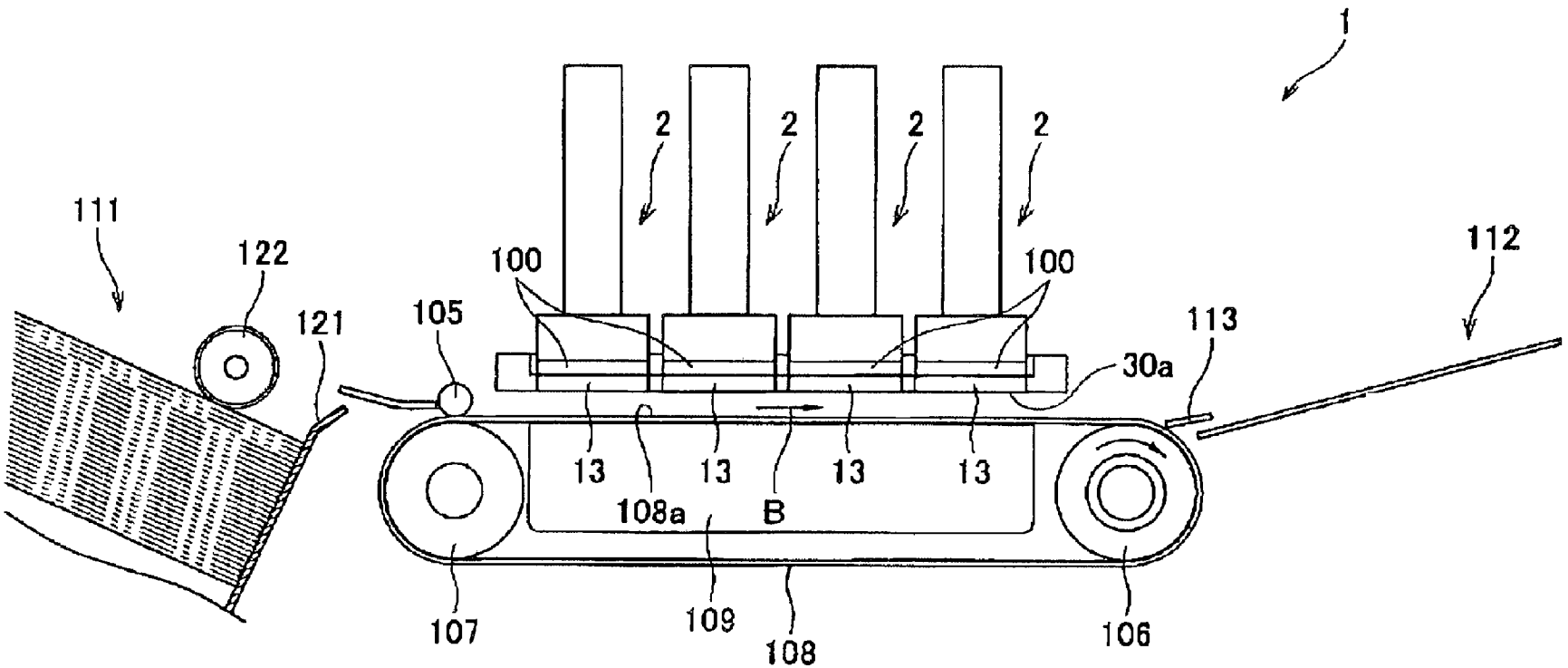
FIG. 1 is a schematic diagram of a printer, according to an embodiment of the present invention.
Figure 2:
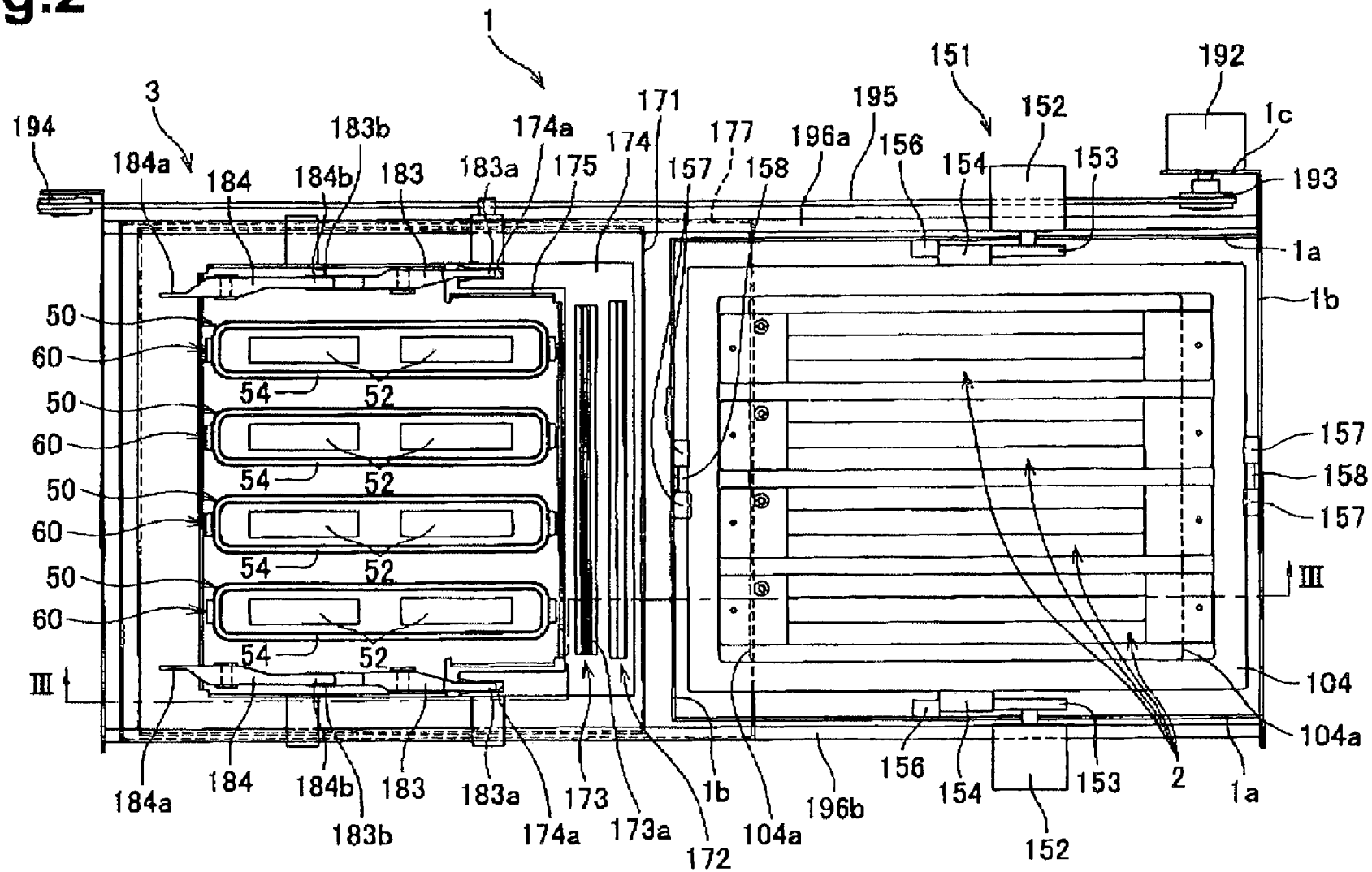
FIG. 2 is a plan view of ink-jet heads of the printer of FIG. 1.

Referring to FIG. 1, an ink-jet printer 1 may be a color ink-jet printer which may comprise four ink-jet heads 2, a sheet feed mechanism 111, and a sheet ejection until 112. Referring to FIG. 2, ink-jet printer 1 also may comprise a maintenance unit 3 disposed to the left of the four ink-jet heads 2. Moreover, the ink-jet printer 1 may comprise a sheet feed mechanism 111, a sheet ejection unit 112, and a sheet transport path formed therebetween inside the ink-jet printer 1. The sheet feed mechanism 111 may comprise a pickup roller 122 for feeding the top one of a plurality of recording sheets accommodated in a sheet tray 121. The ink-jet printer may comprise means for transporting a recording sheet, which may comprise a pair of belt rollers 106 and 107, and a transport belt 108, and may occupy an intermediate portion of the sheet transport path. A transport surface 108*a* of the transport belt 108*a* of the transport belt 108 may have been subjected to a silicone treatment, and consequently, maybe adhesive. A pressing roller 105, which may be disposed immediately downstream of the sheet feed mechanism 111 and may oppose the transport belt 108, applies a pressure to a recording sheet fed from the sheet feed mechanism 111 against the transport surface 108*a*.

A peeling member 113 may be disposed immediately downstream of the transport belt 108 in the sheet transport path. The peeling member 113 may be configured to peel the recording sheet held on the transport surface 108*a* and to transmit the recording toward the sheet ejection unit 112.

A substantially rectangular-parallelepiped-shaped platen 109 may be disposed in the space enclosed by the transport belt 108 and may oppose the ink-jet heads 2, such that it supports the bottom surface of the top portion of the transport belt 108.

The four inkjet heads 2 may be arranged in the sheet transport direction and may correspond to one of four different colors of ink, e.g., magenta, yellow, cyan, and black, such that the ink-jet printer 1 may comprise a line printer.

Figure 3:
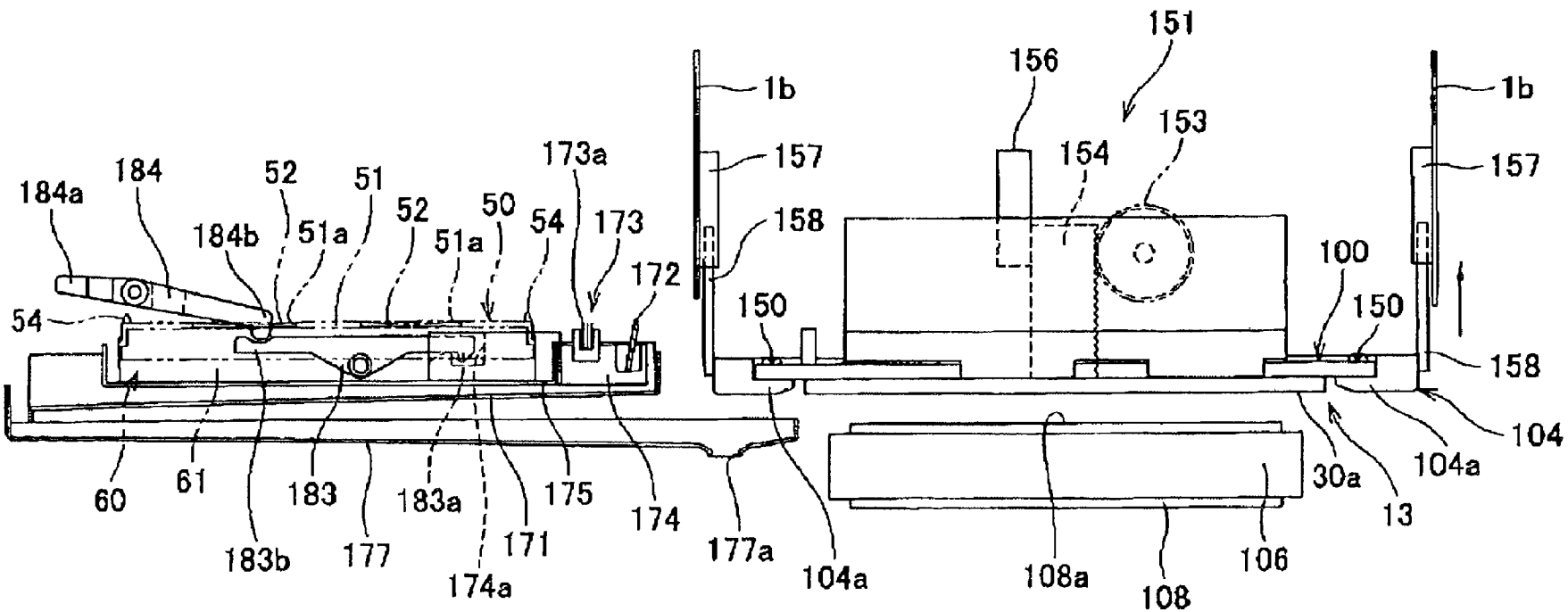
FIG. 3 is a sectional view taken along line III-III in FIG. 2.

The four ink-jet heads 1 may be fixed to a picture-frame-shaped frame 104, and may be arranged adjacent to each other in the sheet transport direction. Referring to FIGS. 2 and 3, the frame 104 may comprise support portions 104*a* which extend outward and oppose the bottom surfaces of both end portions, in the longitudinal direction, of each reservoir unit 100. Both end portions of each reservoir unit 100 may be fixed to the support portions 104*a* via screws 150. Referring to FIG. 3, ink discharge surfaces 30*a* of the ink-jet heads 2, may be exposed via the opening of the frame 104, and may be substantially flush with the bottom surface of the frame 104.

The frame 104 may be supported by frame moving mechanisms 151 of the ink-jet printer 1, and may be movable in the vertical direction. Referring to FIG. 2, the frame moving mechanisms 151 may be disposed on both sides of the four ink-jet heads 2. Each frame moving mechanism 151 may comprise a drive motor 152 as a drive source for moving the frame 104 in the vertical direction, a pinion gear 153 which is fixed to the shaft of the drive motor 152, a rack gear 154 which erects from the frame 104 and meshes with the pinion gear 153, and a guide 156 which is disposed, such that the rack gear 154 is sandwiched between the guide 156 and the pinion gear 153. The two drive motors 152 may be fixed to main body frames 1*a* of the ink-jet printer 1 which are opposed to each other in the sheet transport direction. The two rack gears 154 may extend in the vertical direction and their bottom portions may be fixed to the respective side surfaces of the frame 104. The opposite side surface, to the gear surface, of each rack gear 154 may be in sliding contact with the associated guide 156. The guides 156 may be fixed to the respective main body frames 1*a*.

In this embodiment, when the two drive motors 152 rotate the pinion gears 153 in a synchronized manner, the rack gears 154 move in the vertical direction. As the rack gears 154 move in the vertical direction, the frame 104 and the four ink-jet heads 2 also move in the vertical direction. In order to perform printing on a recording sheet, the ink-jet heads 2 are moved downward, such that the ink discharge surfaces 30*a* are positioned adjacent to and opposite the recording sheet. To perform cleaning with a wiper 172 and an ink absorbing member 173, or to perform capping with caps 50, the ink-jet heads 2 are moved upward.

Guide units may be disposed on both sides, in the longitudinal direction, of the ink-jet heads 2. Each guide unit may comprise a rod-shaped member 158 and a pair of guides 157 between which the rod-shaped member 158 is sandwiched. Referring to FIG. 3, the pair of guides 157 may extend in the vertical direction and may be fixed to main body frames 1*b* which oppose each other in the direction perpendicular to the sheet transport direction. Moreover, the rod-shaped members 158 may extend in the vertical direction similar the guides 157, and may be fixed to the respective side surfaces of the frame 104 which are parallel with and oppose the respective main body frames 1*b*. Each rod-shaped member 158 may be slidably sandwiched between the pair of guides 157. Consequently, when the frame 104 is moved in the vertical direction with respect to the transport surface 108*a* by the frame moving mechanisms 151, the guide units may prevent the ink discharge surfaces 30*a* of the ink-jet heads 2 from becoming inclined from the transport surface 108*a*. Therefore, even when the frame 104 and the ink-jet heads 2 are moved in the vertical direction by the frame moving mechanisms 151, the ink discharge surfaces 30*a* remain parallel with the transport surface 108*a*, which increases printing accuracy.

Figure 5:
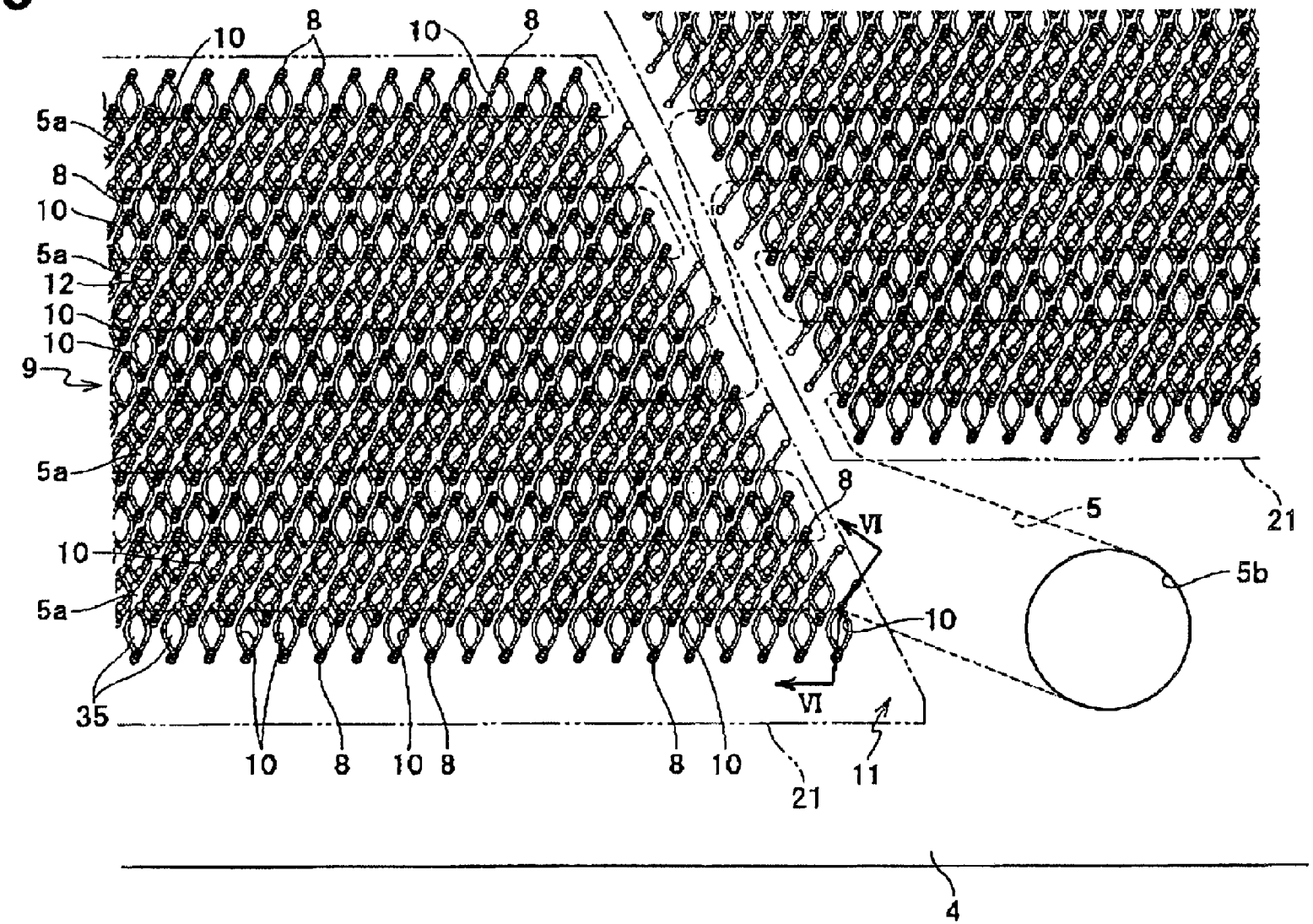
FIG. 5 is an enlarged view of a portion of FIG. 4.

Referring to FIG. 1, each ink-jet head 2 may comprise a head main body 13, and a reservoir unit 100 for supplying ink to the head main body 13 may be fixed to the top surface of the head main body 13. During printing, the frame 104 is moved downward by the frame moving mechanisms 151 and relatively small gaps may be formed between the ink discharge surfaces 30*a* and the transport surface 108*a* of the transport belt 108. The gaps may comprise a portion of the sheet transport path. Referring to FIG. 5, in an embodiment, when a recording sheet is transported by the transport belt 108 and passes under the four head main bodies 13, ink droplets of the individual colors are discharged from nozzles 8 toward the top surface of the recording sheet, whereby a desired color image may be formed on the recording sheet.

Figure 4:
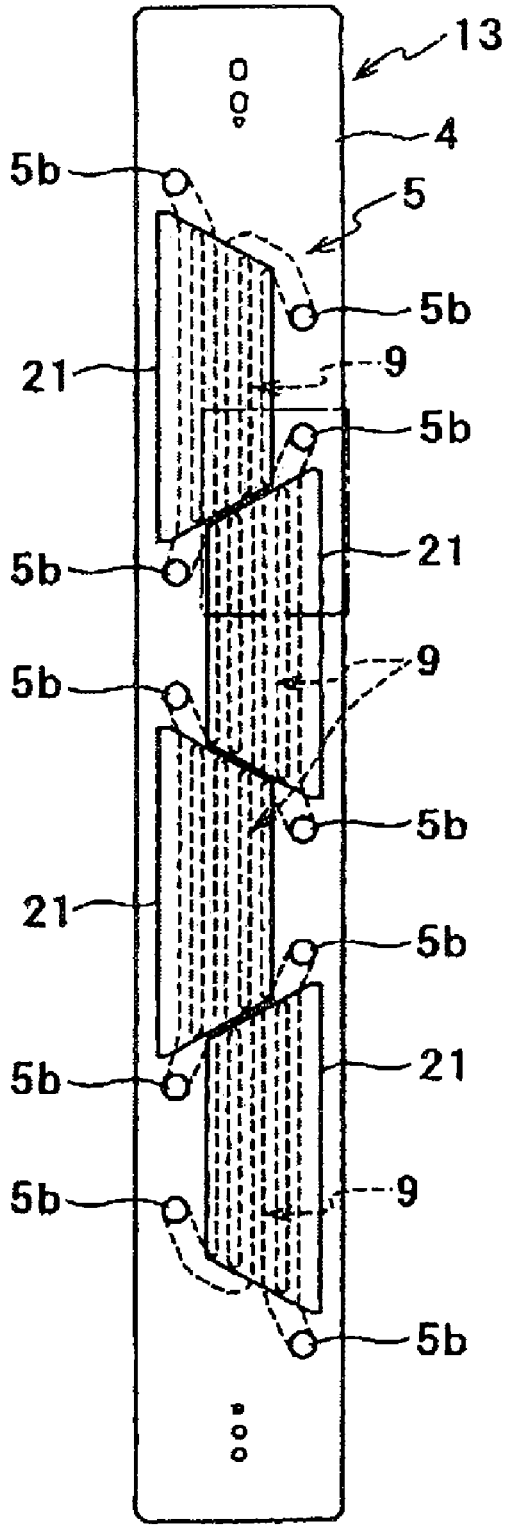
FIG. 4 is a plan view of each head main body of the printer of FIG. 1.

Referring to FIGS. 4 and 5, each head main body 13 may comprise a channel unit 4 in which a plurality of pressure rooms 10 comprising four pressure room groups 9, and a plurality of nozzles 8 which communicate with the respective pressure rooms 10, may be formed. Four trapezoidal piezoelectric actuators 21 which are staggered and arranged in two lines may be bonded to the top surface of the channel unit 4. For example, each piezoelectric actuator 21 may be oriented, such that top and bottom sides extend in the longitudinal direction of the channel unit 4. The oblique sides of adjoining piezoelectric actuators 21 may overlap with teach other in the width direction of the channel unit 4.

The portions of the channel unit 4 which oppose the bonding areas of the piezoelectric actuators 21 are ink discharge regions. Referring to FIG. 5, a plurality of nozzles 8 may be arranged regularly in each ink discharge region, a plurality of pressure rooms 10 may be arranged in matrix form in the top surface of the channel unit 4. A plurality of pressure rooms 10 may be formed in the top surface of the channel unit in the area opposed to one piezoelectric actuator 21, and may comprise one pressure room group 9. One individual electrode 35 positioned in the piezoelectric actuator 21 may oppose each pressure room 10. In this embodiment, 16 lines of pressure rooms 10 may be arranged at regular intervals in the longitudinal direction of the channel unit 4, and may be arranged parallel with each other in the lateral direction. The number of pressure rooms 10 in each line may decrease gradually from the longer side to the shorter side according to the outward shape of the piezoelectric actuator 21. The nozzles 8 may be similarly arranged, and image formation may be performed at a resolution of about 600 dpi.

A plurality of manifold channels 5 may be formed in the channel unit 4. The manifold channels 5 may extend along the oblique sides of the piezoelectric actuators 21 and may cross the longitudinal direction of the channel unit 4. In each area which is interposed between adjoining piezoelectric actuators 21, one manifold channel 5 may be shared by the adjoining piezoelectric actuators 21 and sub-manifold channels 5*a* may branch off to both sides of the one manifold channel 5. In each ink discharge region, four sub-manifold channels 5*a* may extend in the longitudinal direction of the channel unit 4, and may oppose each other. Ink may be supplied to the manifold channels 5 from ink supply openings 5*b* which are formed in the top surface of the channel unit 4.

Each nozzle 8 may be in fluid communication with a sub-manifold channel 5*a* via a pressure room 10 and an aperture 12. The nozzles 8 included in four adjoining nozzle lines extending in the longitudinal direction of the channel unit 4 may be in fluid communication with the same sub-manifold channel 5*a*. Consequently, individual ink channels 32 leading from the exit of a sub-manifold channel 5*a* to corresponding nozzles 8 past pressure rooms 10 may be formed inside the channel unit 4.

Figure 6:
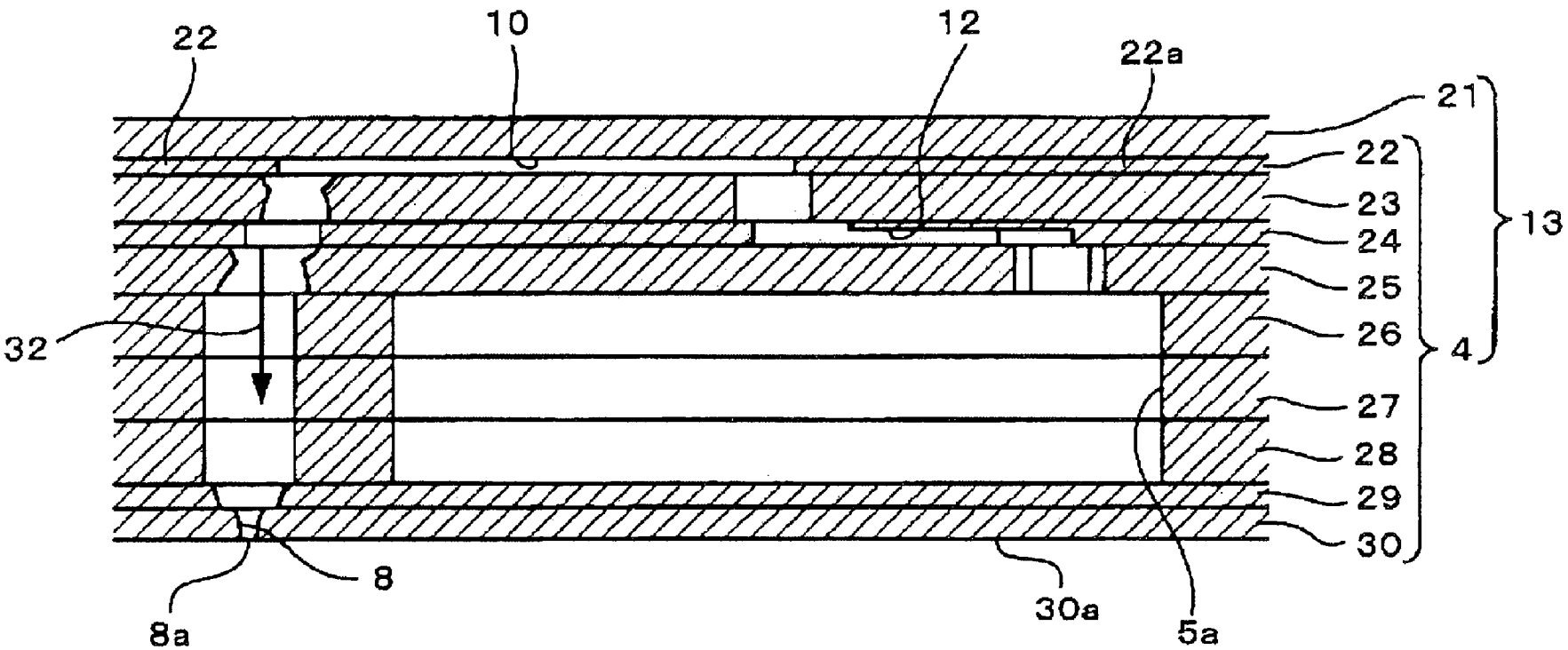
FIG. 6 is a sectional view of a piezoelectric actuator taken along line VI-VI in FIG. 5.

Referring to FIG. 6, each head main body 13 may comprise a channel unit 4 and piezoelectric actuators 21. To form each channel unit 4, a cavity plate 22, a base plate 23, an aperture plate 24, a supply plate 25, manifold plates 26, 27, and 28, a cover plate 29, and a nozzle plate 30 may be sequentially positioned on top of each other. Ink channels may be formed inside the channel unit 4. Each ink channel may comprise a manifold channel 5 for temporarily storing ink, a sub-manifold channel 5*a*, and an individual ink channel 32 which extends from the exit of the sub-manifold 5*a* to a nozzle 8. The plates 22-30 may be sequentially positioned on top of each other to form the elements comprising the ink channels.

The cavity plate 22 may comprise a metal plate in which a plurality of substantially rhombic holes are formed and act as pressure rooms 10. The base plate 23 may comprise a metal plate in which a plurality of communication holes for communication between the pressure rooms 10 and the corresponding apertures 12 and a plurality of communication holes for communication between the pressure rooms 10 and the corresponding nozzles 8 may be formed. The aperture plate 24 may comprise a metal plate in which a plurality of the apertures 12 and plurality of communication holes for communication between the pressure rooms 10 and the corresponding nozzles 8 may be formed. The supply plate 25 may comprise a metal plate in which a plurality of communication holes for communication between the apertures 12 and the sub-manifold channels 5*a*, and a plurality communication holes for communication between the pressure rooms 10 and the corresponding nozzles 8, may be formed. Each of the manifold plates 26, 27, and 28 may comprise a metal plate in which a plurality of holes corresponding to the sub-manifold channels 5, and a plurality of communication holes for communication between the pressure rooms 10 and the corresponding nozzles 8, may be formed. The cover plate 29 may comprise a metal plate in which a plurality of communication holes for communication between the pressure rooms 10 and the corresponding nozzles 8 may be formed. The nozzle plate 30 may comprise a metal plate in which the plurality of nozzles 8 may be formed. The bottom surface of the nozzle plate 30 may be the ink discharge surface 30*a* in which the ink discharge apertures 8*a* are arranged, the metal plates 22-30 may be positioned on each other to form the individual ink channels 32.

Figure 7A:
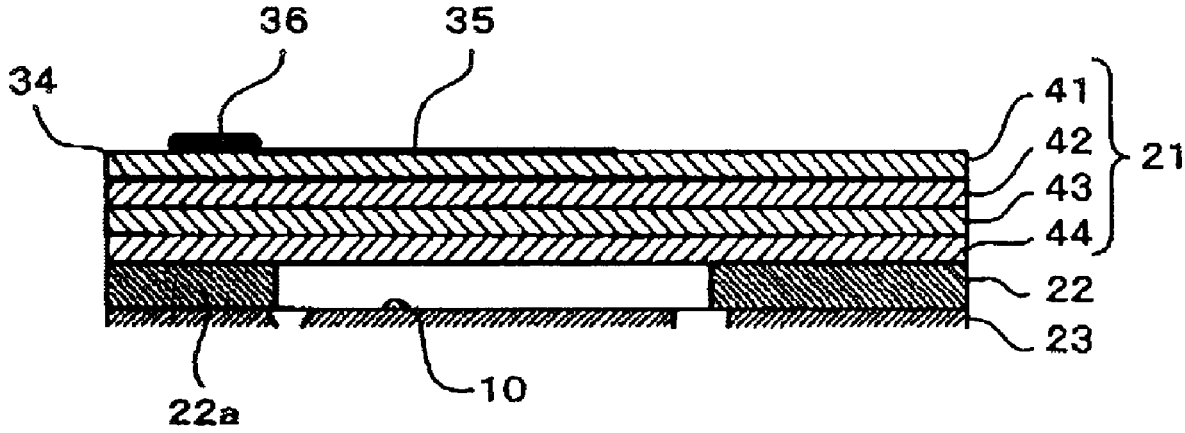
FIG. 7A is an enlarged view of a portion of FIG. 6.

Referring to FIG. 7A, the piezoelectric actuator 21 may comprise four piezoelectric layers 41-44 positioned on top of each other. Each of the piezoelectric layers 41-44 may have a thickness of about 15 μm, such that the thickness of the piezoelectric actuator 21 may be about 60 μm. Each of the piezoelectric layers 41-44 may be a continuous flat-plate layer which bridges the pressure rooms 10. The piezoelectric layers 41-44 may comprise a ferroelectric, lead-zirconate-titanate (PZT)-based ceramic material.

Individual electrodes 35 having a thickness of about 1 μm may be positioned on the top piezoelectric layer 41. The individual electrodes 35 and a common electrode 34 may be formed by printing conductive paste containing a conductive material, such as a noble metal of Ag—Pd, Pt, or Au. Referring to FIG. 7A, each individual electrode 35 may be substantially rhombic and may oppose the corresponding pressure room 10. Therefore, referring to FIG. 5, the plurality of individual electrodes 35 may be arranged regularly and two-dimensionally on the top piezoelectric layer 41. In this embodiment, because the individual electrodes 35 are positioned on the surface of each piezoelectric actuator 21, only the outermost piezoelectric layer 41 may include active regions where piezoelectric strains are caused by external electric fields.

Figure 7B:
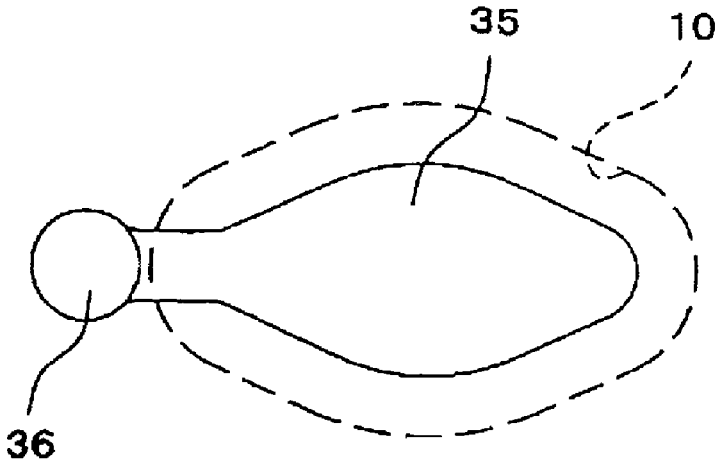
FIG. 7B is an illustration of a relationship between an individual electrode and a pressure room.

One acute-angled portion of each individual electrode 35 may extend to a beam portion 22*a*, e.g., a portion of the cavity plate 22 where no pressure room 10 is formed, of the cavity plate 22 which is bonded to and supports the piezoelectric actuator 21. A land 36 may be formed in a top portion of the extended portion. Referring to FIG. 7B, the land 36 may be substantially circular and may have a thickness of about 15 μm. The land 36 may comprise the same conductive material as the individual electrode 35 and the common electrode 34, and may be electrically connected to the individual electrode 35.

The common electrode 34 may have a thickness of about 2 μm and may be sandwiched between the top piezoelectric layer 41 and the underlying piezoelectric layer 42. Therefore, each portion of the piezoelectric layer 41 which opposes a pressure room 10 may be sandwiched between a pair of electrodes.

The plurality of individual electrodes 35 may be electrically connected to a driver IC via a flexible printed circuit (FPC) which may be connected to the lands 36. The common electrode 34 may be electrically connected to surface electrodes which may be positioned on the surface of the piezoelectric layer 41 adjacent to its four corners so as to avoid electrodes of the individual electrodes 35. The surface electrodes may be connected to the driver IC via the FPC. The driver IC selectively applies drive potentials to the respective individual electrodes 35, and maintains the potential of the common electrode 34 at the same ground potential in the areas which oppose the pressure rooms 10.

In an embodiment, in each piezoelectric actuator 21, only the piezoelectric layer 41 is polarized in the direction from the individual electrodes 35 to the common electrode 34. When predetermined drive voltage is applied to an individual electrode 35 by the driver IC, a potential difference occurs in the region which is sandwiched between the individual electrode 35 applied with the drive voltage and the common electrode 43. Therefore, an electric field develops in this portion of the piezoelectric layer 41 in the thickness direction, and this portion of the piezoelectric layer 41 contracts in the direction perpendicular to the polarization direction due to the transverse piezoelectric effect. The other piezoelectric layers 42-44 do not contract because no electric fields develop there. Therefore, unimorph deformation which is convex toward the pressure room 10 may be generated the portion of the piezoelectric layers 41-44 which includes the active region. Consequently, the capacity of the pressure room 10 may be decreased in order to increase the ink pressure, whereby ink is discharged from the nozzle 8. When the potential of the individual electrode 35 is thereafter returned to the ground potential, the piezoelectric layers 41-44 restore the original shape, and the capacity of the pressure room 10 returns to the original value. Ink is thus drawn into the individual ink channel 32 out of the sub-manifold channel 5*a*.

In another embodiment, the individual electrodes 35 may receive a predetermined drive potential in advance. Each time a discharge request occurs for an individual electrode 35, its potential is temporarily charged to the ground potential, and then returned to the predetermined drive potential. In this case, the piezoelectric layers 41-44 are restored to their original state when the individual electrode 35 is given the ground potential and the capacity of the pressure room 10 is increased to be greater than in the initial state, whereby ink is drawn into the pressure room 10 out of the sub-manifold channel 5*a*. When the predetermined drive potential is again applied to the individual electrode 35, the portion of the piezoelectric layers 41-44 which includes the active region deforms and becomes convex toward the pressure room 10. Moreover, the capacity of the pressure room 10 changes to increase the ink pressure, whereby ink is discharged from the nozzle 8.

Referring to FIGS. 2 and 3, the maintenance unit 3 may be positioned on the left side of the ink-jet heads 2. The maintenance unit 3 may comprise two frames 171 and 175 which are movable in the horizontal direction. A waste ink receiving member 177 may be positioned under the maintenance unit 3. An ink ejection hole 177*a* may be formed adjacent to the ink-jet-heads-2-side end of waste ink receiving member 177, and may penetrate through the bottom wall of the waste ink receiving member 177. The ink ejection hole 177*a* may eject ink which flows into the waste ink receiving member 177. When the frames 171 and 175 move in the horizontal direction, the frame 104 moves upward to form a space for accommodating the maintenance unit 3 between the ink discharge surfaces 30*a* of the four ink-jet heads 2 and the transport surface 108*a*. When the maintenance unit 3 is positioned within the space, the ink discharge surfaces 30*a* are positioned adjacent to the frames 171 and 175.

Referring to FIG. 2, the frame may be movably supported by a pair of guide shafts 196*a* and 196*b* which extend perpendicularly to the sheet transport direction. The guide shafts 196*a* and 196*b* may oppose the two respective side end portions of the frame 171, and the frame 171 may move in the right-left direction along the guide shafts 196*a* and 196*b*. The frame 171 may be fixed to a running belt 195 which is positioned parallel to the guide shaft 196*a*. The two end portions of the running belt 195 may be supported by an idle pulley 194 and a motor pulley 193 which is connected to a motor 192. When the motor 192 is driven, the motor pulley 193 and the running belt 195 rotate, which moves the frame 171 in the right-left direction.

The frames 171 and 175 engage each other via engagement portions. The engagement portions may be positioned on the two respective pairs of sidelines of the frames 171 and 175. Each of the engagement portions may comprise a recess 174*a* which may be provided in a holding member 174 of the frame 171, and a hook member 183 which may be rotatably supported by the frame 175. The recess 174*a* may be formed adjacent to the ink-jet-heads-2-side end of the frame 175. The hook member 183 may extend perpendicularly to the sheet transport direction, and may be rotatably supported by two flanges which are provided adjacent to its center. A hook 183*a* may be positioned at the ink-jet-heads-2-side end of the hook member 183, and may engage the recess 174*a*. A contact member 184 of each hook member 183 may be positioned and rotably supported maintenance unit 3, and may contact an end portion 183*b*. An end portion 184*a* of the contact member 184 may be connected to an extendable and contractible cylinder (not shown). Referring to FIG. 3, when the cylinder contracts each contact member 184 rotates clockwise and an ink-jet-heads-2-side end portion 184*b* of the contact member 184 contacts the end portion 183*b* of the hook member 183. Consequently, the hook member 183 rotates counterclockwise and the hook 183*a* disengages from the recess 174*a*. In contrast, when the cylinder extends, the contact member 184 rotates counterclockwise and separates from the end portion 183*b* of the hook member 183. Then, the hook member 183 rotates clockwise and the hook 183*a* engages the recess 174*a* as shown in FIG. 3.

When the hook 183*a* is not engaged with the recess 174*a*, the frame 175 does not move. In contrast, when the hook 183*a* is engaged with the recess 174*a*, the frame 175 and the frame 171 move in the right-left direction.

Referring to FIGS. 2 and 3, the frame 171 may have a rectangular, box shape, and may comprise a top which opens to accommodate the frame 175. Because the side of the frame 171 opposite the inkjet heads 2, is open, when the hook 183*a* is not engaged with the recess 174*a*, only the frame 171 moves and the frame 171 leaves the frame 175 which is accommodated therein. The waste ink receiving 177 may be configured to receive the frame 171, and may be shaped, such that when the frame 171 moves to the right end of its movable range, an end portion of the frame 171 is positioned over the waste ink receiving member 177.

Referring to FIG. 2, the holding member 174 which holds the wiper 172 and the ink receiving member 173 may be fixed to the frame 171 and may be positioned on the ink-jet heads 2 side. The holding member 174 may have a bracket shape, and may hold the wiper 172 and the ink receiving member 173 in portions extending the sheet transport direction. Recesses 174*a* may comprise two respective portions extending perpendicularly to the sheet transport directing of the holding member 174.

Referring to FIGS. 2 and 3, the ink receiving member 173 may comprise a plurality of plates 173*a* which may be longer than the width of the ink-jet heads 2. The plates 173*a* may be positioned parallel with each other at a predetermined interval, such that a capillary force acts on ink. The wiper also may be 172 longer than the width of the ink-jet heads 2, and the wiper 172 may be positioned, such that its longitudinal direction is parallel with the sheet transport direction. The wiper 172 may comprise an elastic material, such as rubber.

In order to clean the ink discharge surfaces 30*a*, the frame 104 is moved upward by the frame moving mechanisms 151, which creates a space for accommodating the maintenance unit 3 between the ink discharge surfaces 30*a* and the transport surface 108*a*. Then, referring to FIG. 8A, the frame 171 is moved rightward, such that the wiper 172 and the ink receiving member 173 are positioned on the right of the right-hand ends of the ink-jet heads 2. The main bodies 13 then are moved, such that the ink discharge surfaces 30*a* are positioned above the tops of the plates 173*a* and below the top of the wiper 172.

In this state, ink droplets are discharged from the nozzles 8 by applying pressure to the ink in the ink channels via the piezoelectric actuators 21, a pump (not shown), or the like. Consequently, clogging of nozzles 8 may be prevented. The ink which is discharged from the nozzles 8 flow across the bottom surface of the frame 171 and flows into the waste ink receiving member 177 from the end portion of the frame 171. Portions of the inks remain on the ink discharge surfaces 30*a* in the form of ink droplets.

Figure 8A:
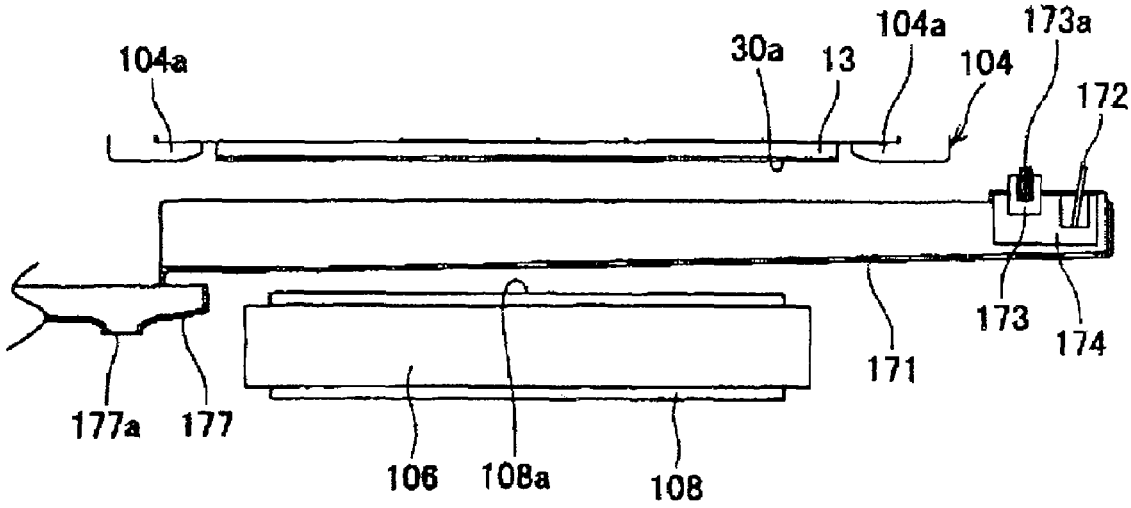
FIGS. 8A and 8B show how ink discharge surfaces are cleaned by a wiper and an ink receiving member of FIG. 3.
Figure 8B:
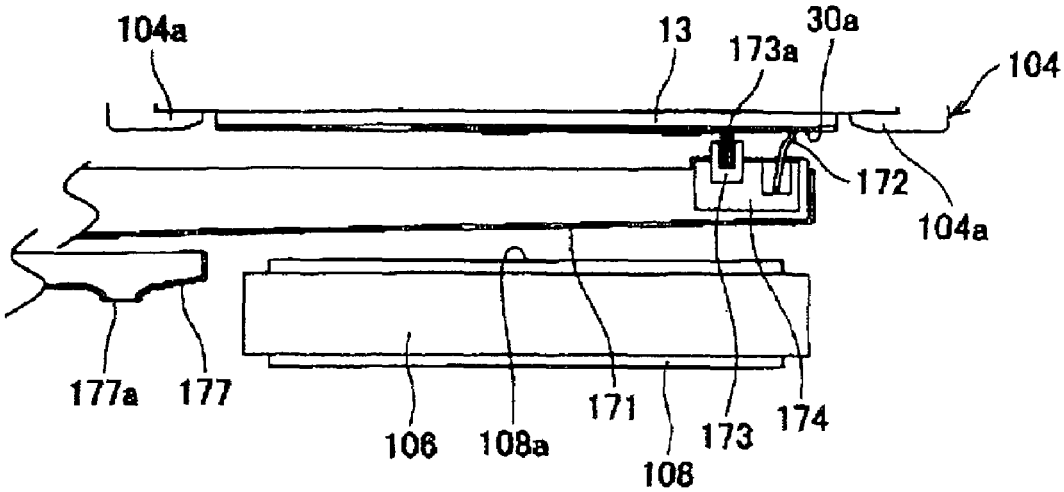

Referring to FIG. 8B, the frame 171 is moved leftward and returned to its original position. At this time, because a gap is formed between the plates 173*a* and the ink discharge surfaces 30*a*, the tips of the plates 173*a* do not contact the ink discharge surfaces 30*a* and only contacts the inks on the ink discharge surfaces 30*a*. Therefore, the ink on the ink discharge surfaces 30*a* are moved to between the plates 173*a* by the capillary affect. The wiper 172 contacts the ink discharge surfaces 30*a* and removes which was not removed by the plates 173*a*. The removed ink then flows into the waste ink receiving member 177 via the frame 171.

Four sets of a cap 50 and a cap holder 60 may be arranged in the frame 175 in the sheet transport direction. Each of the four caps 50 may have a substantially rectangular shape. For example, when an operation of the ink-jet printer 1 concludes, the frame 175 may move with the frame 171 to oppose the inkjet heads 2. The caps 50 then may contact the respective ink discharge surfaces 30*a*, which protects the ink discharge surfaces 30*a* and prevents the ink viscosity in the nozzles 8 from increasing.

Referring to FIGS. 2, 3, 9A, and 9B, cap 50 and a cap holder 60 may be fixed to the bottom surface of the frame 175. The cap 50 and the cap holder 60 may be arranged in the sheet transport direction at the same pitch as the ink-jet heads 2.

Referring to FIGS. 9A, 9B, 10, and 12, each cap 50 may comprise a base member 51, at least one, e.g., two, damper film 52, and a lip 54. The base member 51 may have a substantially rectangular plate-like body which may be substantially the same size as the ink discharge surface. The top surface of the base member 51 may have two recesses 51*a* formed therein, which may be concave downward. The recesses 51*a* may be substantially symmetrical with respect to center lines, of the base member, in the longitudinal and lateral directions of the base member 51. Each recess 51*a* may have a substantially rectangular shape which is longer in the longitudinal direction of the base member 51. The recesses 51*a* may reduce the rigidity of the base member 51. Therefore, the lip 54 may contact the ink discharge surface 30*a* with a weaker force, and a uniform force may act on their contact portion. Alternatively, the recesses 51*a* may be replaced by through-holes having substantially the same size as the recesses 51*a*.

A communication hole 51*b* penetrates through the bottom wall of each recess 51*a*, substantially at its center. Each recess 51*a* thereby may be exposed to the external air via the communication hole 51*b*.

The damper films 52 may be connected to the top surface of the base member 51 and may cover the recesses 51*a*, and joining portions may surround the respective recesses 51*a*. Consequently, the spaces enclosed by the recesses 51*a* and the damper films 52 may be exposed to the external air via the communication holes 51*b*. The damper films 52 may be connected to the base member 51 and may be sent convex toward the bottom surfaces of the recesses 51*a* in a non-capped state. In this embodiment, the damper films 52 are fixed to the base member 51 with an adhesive. In the bonding process, the damper films 52 may be pressed by a jig and thereby may be fixed to the base member 51 in a deformed state, e.g., the damper films 52 may be wrinkled. Another structure would be such that the recesses 51*a* are alternatively, projections may be formed on the base member 51 around the recesses 51*a*, and the damper films 52 may be fixed to the projections.

Figure 9A:
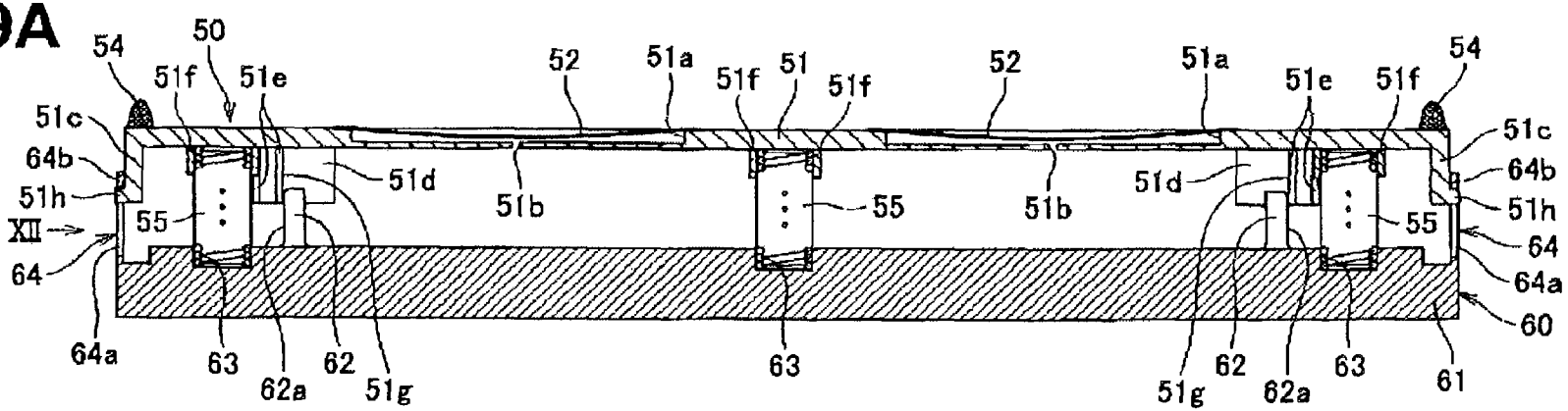
FIGS. 9A and 9B are sectional views of a cap and a cap holder of FIG. 2 when the ink discharge surface is not capped and when the ink discharge surface is capped, respectively, according to an embodiment of the present invention.
Figure 9B:
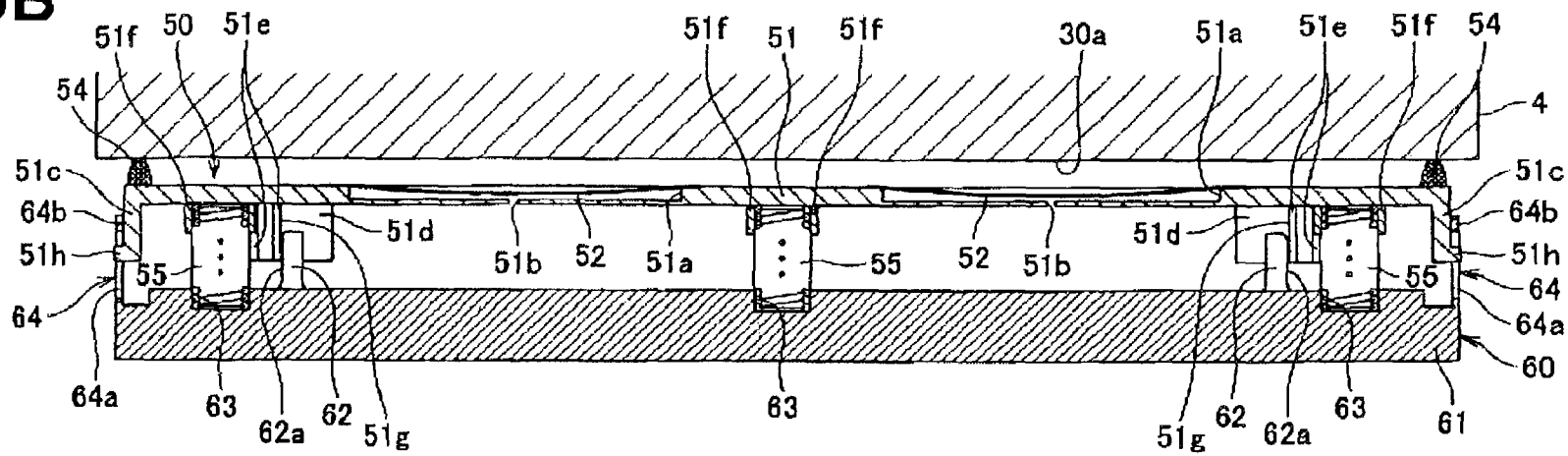
Figure 10:
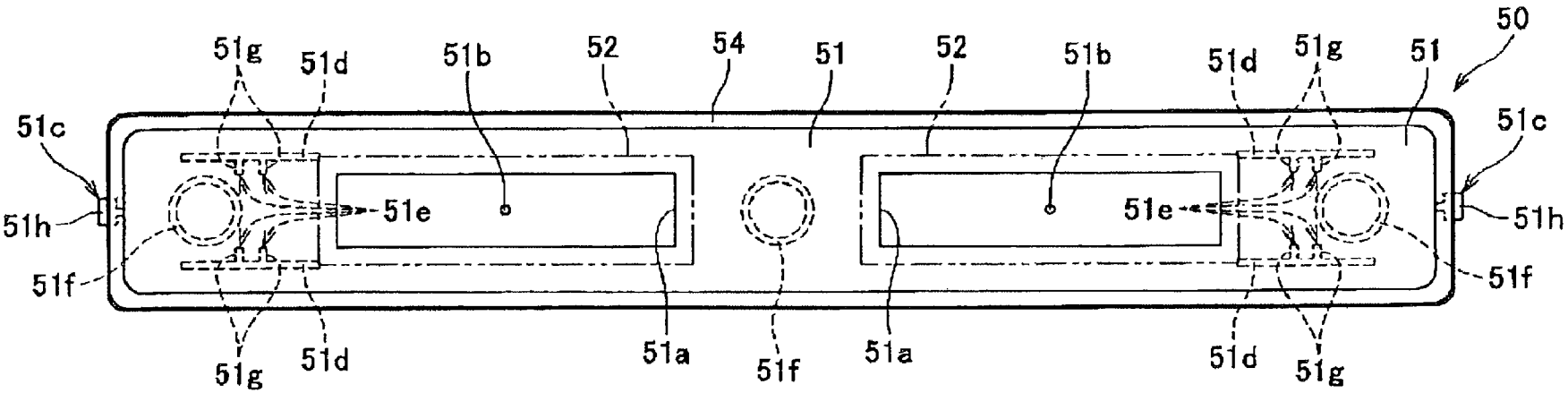
FIG. 10 is a plan view of the cap of FIGS. 9A and 9B.
Figure 11:
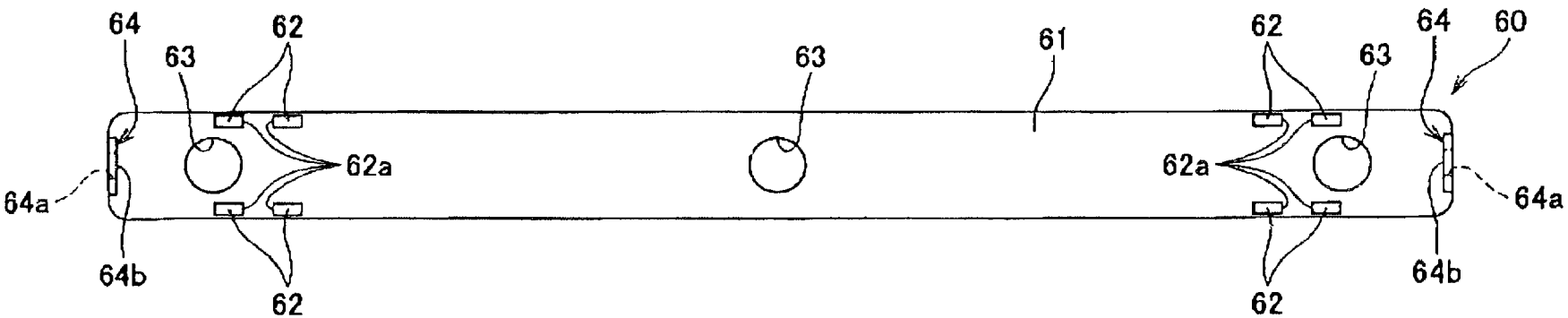
FIG. 11 is a plan view of the cap holder of FIGS. 9A and 9B.
Figure 12:
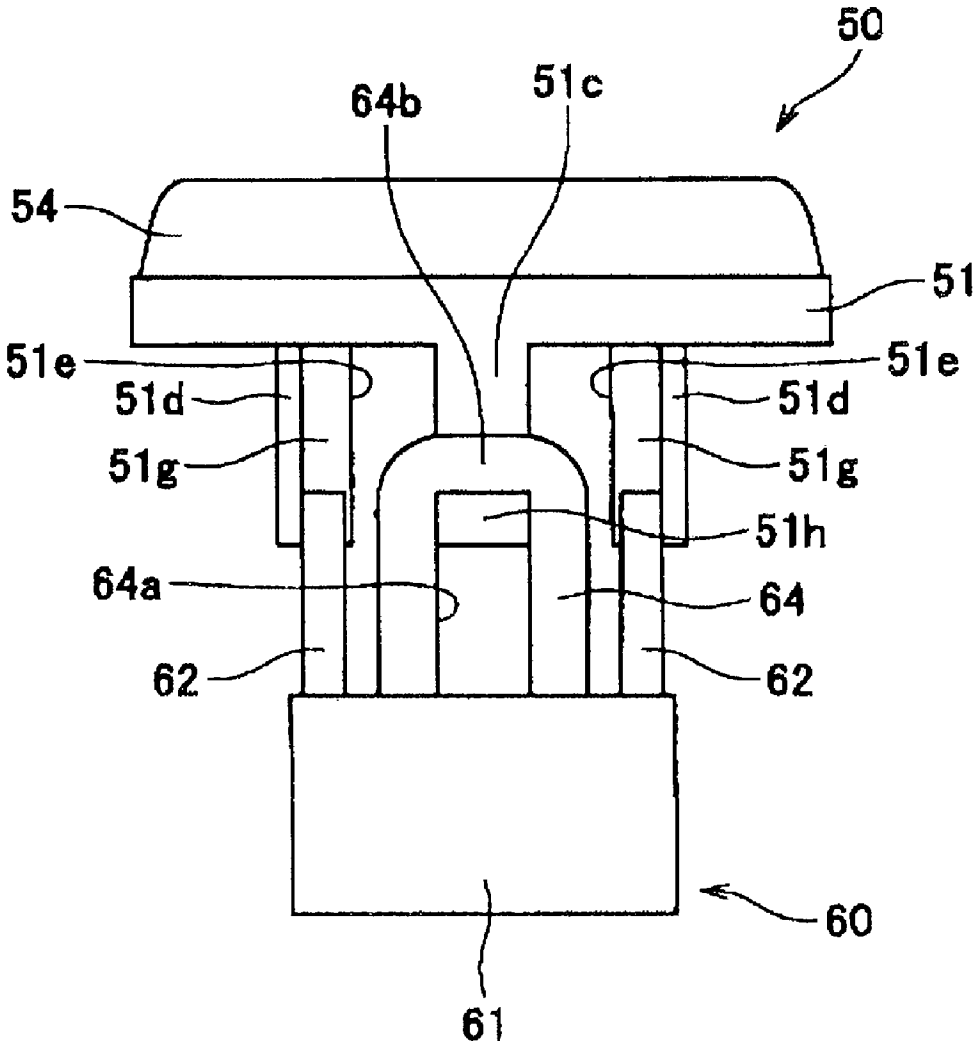
FIG. 12 is a side view of FIG. 9A as viewed from the direction indicated by arrow XII.

Moreover, the lip 54 may be positioned on the top surface of the base member 51 along the outer periphery of the base member 51. Referring to FIGS. 9A and 9B, the lip 54 may be thickest at about its center. When the lip 54 contacts the ink discharge surface 30*a*, the ink discharge surface 30*a* may be covered with the cap 50 and the space enclosed by the cap 50 and the ink discharge surface 30*a* may be isolated from the outside. This prevents the ink inside the nozzles 8 from drying and increasing in viscosity. In this state, all the ink discharge apertures 8*a* in the ink discharge surface 30*a* are covered with the cap 50.

The bottom surface of the base member 51 may comprise four ribs 51*d*, three spring attaching portions 51*f*, and two cap holder attaching portions 51*c*, each of which project downward.

The four ribs 51*d* may be positioned adjacent to the four respective corners of the base member 51, and may be symmetrical with respect to the center lines of the base member 51 in the longitudinal and lateral directions of the base member 51. Each rib 51*d* may be positioned substantially at the center in its longitudinal direction, with two projections 51*e* which project in the lateral direction of the base member 51. A side surface 51*g* of each projection 51*e* extends in the vertical direction and may oppose and contact a side surface 62*a* of a projection 62 of the cap holder 60. The cap 50 and the cap holder 60 may be positioned with respect to each other because the side surfaces 51*g* and the side surfaces 62*a* contact other. Moreover, the cap 50 may be moved in the vertical direction relative to the cap holder 60 as the side surfaces 51*g* are moved parallel with the side surfaces 62*a*.

The three spring attaching portions 51*f* may be substantially cylindrical, and may project from the bottom surface of the base member 51. The three spring attaching portions 51*f* may be positioned substantially at the center of the base member 51 and between each pair of ribs 51*d* that oppose each other, such that the spring attaching portions 51*f* are symmetrical with respect to the center lines of the base member 51. Top portions of springs 55 may be attached to the respective spring attaching portions 51*f*.

Each of the two cap holder attaching portions 51*c* may be positioned at an end portion of the base member 51, and the bottom portion of cap holder attaching portions 51*c* may comprise a projection 51*h* which projects outward in the longitudinal direction of the base member 51. The cap holder attaching portions 51*c* may be attached to respective cap attaching portions 64 of the cap holder 60, and the cap 50 may be positioned with respect to the cap holder 60. the cap 50 may be moved in the vertical direction relative to the cap holder 60 as the projections 51*h* are moved along respective grooves 64*a* of the cap holder 60. Because the projections 51*h* may contact respective coming-off preventing portions 64*b* of the cap holder 60, the cap 50 may be prevented from being removed from the cap holder 60.

Each of ribs 51*d*, the spring attaching portions 51*f*, and cap holder attaching portions 51*c* may be distributed in the longitudinal direction of the base member 51, which may increase the rigidity of the base member 51. Moreover, the spring attaching portions 51*f*, and the cap the base member 51 may not deform. Therefore, even if the base member 51 is warped, the lip 54 may sufficiently contact the ink discharge surface 30*a* without having to increase the force applied by the cap 50 toward the ink discharge surface 30*a*. The recesses 51*a* also may allow the base member 51 to be flexible.

Referring to FIGS. 9A, 9B, 11, and 12, the cap holder 60 may comprise a holder base member 61 which may be substantially rectangular. Eight projections 62, three spring attaching recesses 63, and two cap attaching portions 64 may be positioned on the top surface of the holder base member 63.

The holder base member 61 may have a substantially rectangular parallelepiped shape which is about as long as the cap 50 in the longitudinal direction and is shorter than the cap 50 in the lateral direction.

Each of the projections 62 may be positioned, such that the two projections 51*e* of the associated rib 51*d* are sandwiched between the pair of projections 62. The side surfaces 51*g* of the projections 51*e* of the cap 50 may oppose and contact the side surfaces 62*a* of the projections 62 of the cap holder 60, whereby the cap 50 and the cap holder 60 are positioned with respect to each other. The cap 50 may be moved in the vertical direction relative to the cap holder 60 as the side surfaces 51*g* are moved parallel with the side surfaces 62*a*. Moreover, the outside side surfaces of the projections 62 may contact the inside side surfaces of the cap 50 of the ribs 51*d*, which restricts the inclination of the cap 50 in the lateral direction. The cap 50 then may be moved in the vertical direction to be substantially perpendicularly to the cap holder 60.

The three spring attaching recesses 63 may be positioned, such that those portions of the holder base member 61 which oppose the three spring attaching portions 51*f* are dented downward. Bottom portions of the springs 55 may be attached to the respective spring attaching recesses 63.

The two cap attaching portions 64 may be positioned at positions corresponding to the two respective cap holder attaching portions 51*c*. A groove 64*a* may be formed in each cap attaching portion 64 substantially at the center in the lateral direction of the holder base member 61, and may extend in the vertical direction. A coming-off preventing portion 64*b* may be positioned adjacent to the top end of the groove 64*a*, and may extend in the lateral direction of the holder base member 61. The coming-off preventing portion 64*b* may define the top end of the groove 64*a*. When the cap 50 is attached to the cap holder 60, the projections 51*h* of the cap holder attaching portions 51*c* may engage the respective grooves 64*a*. The cap 50 may be moved in the vertical direction relative to the cap holder 60 as the projections 51*h* are moved along the grooves 64*a*. Moreover, because the top ends of the projections 51*h* contact the bottom ends of the coming-off preventing portions 64*b*, the cap 50 may be prevented from being removed from the cap holder 60. Specifically, the cap 50 may be moved downward until the bottom ends of the projections 51*h* contact the top surface of the holder base member 61, and may be moved upward until the top ends of the projections 51*h* contact the bottom ends of coming-off preventing portions 64*b*.

The three springs 55 may be sandwiched between the cap 50 and the cap holder 60. Both ends of each spring 55 may be attached to the associated spring attaching portion 51*f* of the cap 50 and the associated spring attaching recess 63 of the cap holder 60. The springs 55 may urge the cap 50 to be separated from the cap holder 60. When the cap 50 contacts the ink discharge surface 30*a*, the cap 50 is pressed against the ink discharge surface 30*a* by the springs 55. In this manner, the cap holder 60 may press the cap 50 via the springs 55. The springs 55 push the cap 50 upward wherever the cap 50 is positioned relative to the cap holder 60, which stabilizes the vertical movement of the cap 50 stable.

The frame 104 may be moved upward by the frame moving mechanisms 151, whereby the head main bodies 13 are positioned, such that the ink discharge surfaces 30*a* are positioned higher than the tops of the lips 54. then, the frame and the frame 171 may be moved rightward when the hooks 183*a* are engaged with the recesses 174*a*, which results in the top surfaces of the base members 51 opposing the ink discharge surfaces 30*a*. Then, the frame 104 is moved downward by the frame moving mechanisms 151, which results in the lips 54 contacting the ink discharge surfaces 30*a*. Consequently, the spaces enclosed by the ink discharge surfaces 30*a*, the top surfaces of the base members 51, and lips 54 may be isolated from the outside. In this state, the lips 54 contact the ink discharge surfaces 30*a* reliably because the springs 55 press the caps 50 upwards. Moreover, even if a base member 51 is warped, the base member 51 id deformed to conform to the ink discharge surface 30 because of the pressing force of the springs 55. As such, the shape of the lips 54 follow the shape of the ink discharge surfaces 30*a*, and the lips 54 reliably contact the ink discharge surfaces 30*a* even when the pressing forces of the springs 55 is relatively weak. At this time, the ribs 51*d*, spring attaching portions 51*f*, and cap holder attaching portions 51*c* do not obstruct the deformation of the base member 51, and a uniform force acts on the portion where each lip 54 contacts the associated ink discharge surface 30*a*. When each lip 54 contacts the associated ink discharge surface 30*a*, the pressing force of the springs 55 may be selected to be less than the product of the withstand pressure of ink menisci in the nozzles 8 and he area of that portion of the base member 51 which is enclosed by the lip 54.

When the air pressure in the cap 50 is reduced, e.g., because of a decrease in the temperature of air around the cap 50, the damper films 52 may deform upward toward the ink discharge surface 30*a* due to the difference between the air pressure in the cap 50 and the atmospheric pressure. Because of the deformation of the damper films 52, the capacity of the cap 50 may decrease whereby the air pressure in the cap 50 may increase and about equally to the atmospheric pressure. When the damper films 52 are fully deformed upward, they may be bent to such an extent as not to contact the ink discharge surface 30*a*.

In contrast, when the air pressure in the cap 50, increases, e.g., because of an increase of the temperature of air around the cap 50, the damper films 52 may deform downward toward the recesses 51*a* because the air pressure in the cap 50 is greater than the air pressure in the recesses 51*a*. At this time, the damper films 52 are deformed in such a manner that their wrinkles disappear. Because of the deformation of the damper films 52, the capacity of the cap 50 increases, whereby the air pressure in the cap 50 decreases. At this time, the damper films 52 may be deformed to such an extent as to contact the bottom surfaces of the recesses 51*a*.

Figure 13A:
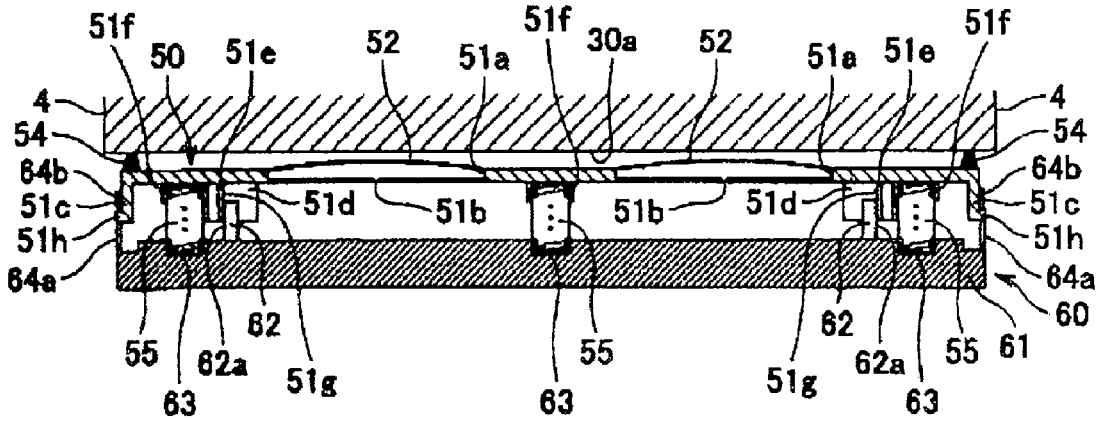
FIGS. 13A-13C show how a cap operates when the air pressure in the cap of FIG. 9B varies.
Figure 13B:
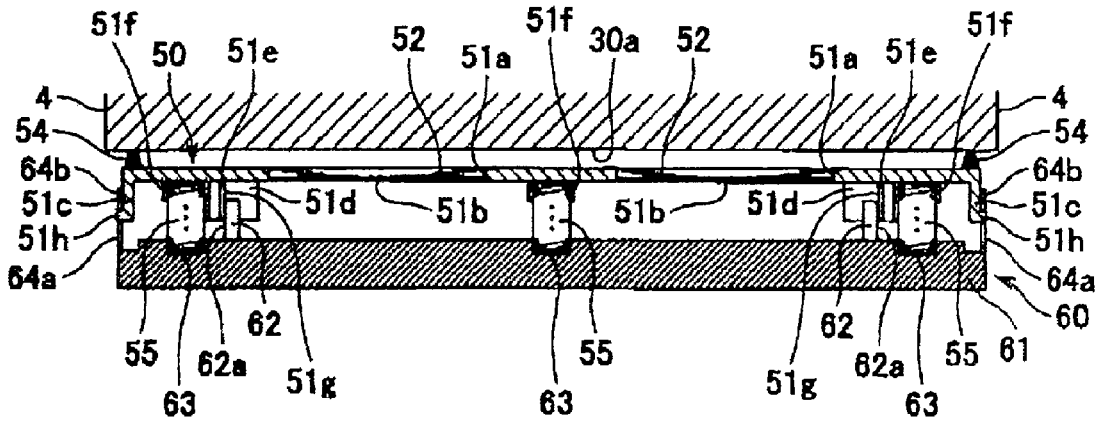
Figure 13C:
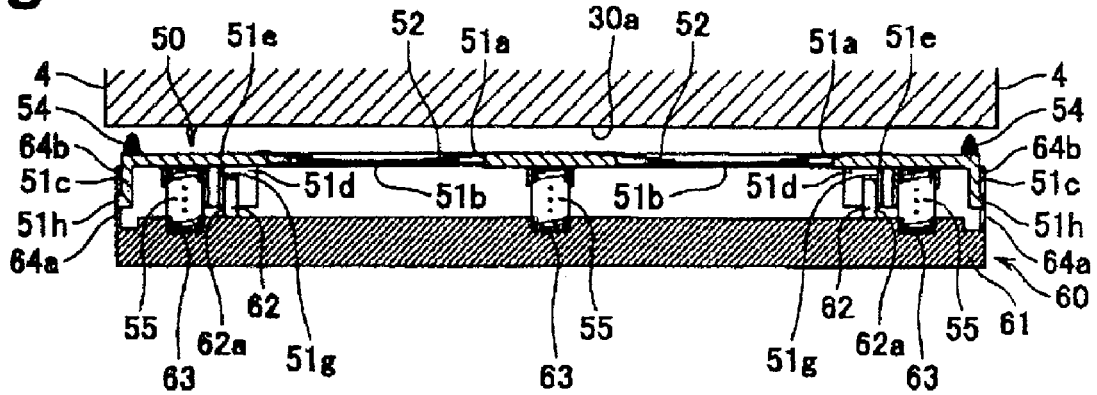

When the air pressure in the cap 50 substantially increases, the force of the air inside the cap 50 that presses the cap 50 downward is relatively great. Referring to FIGS. 13B and 13C, when the deformation of the damper films 52 is insufficient to compensate for the increase of the air pressure in the cap 50, a portion of the cap 50 may move downward because the force of the springs 55 which press the cap 50 is selected to be less than the product of the withstand pressure of ink menisci in the nozzles 8 and the area of that portion of the base member 51 which is enclosed by the lip 54. Consequently, a gap if formed between the lip 54 and the ink discharge surface 30*a*, and air flows out of the cap 50 through the gap. Moreover, the air pressure in the cap 50 may be decreased to be about equal to the atmospheric pressure. At this time, damper films 52 return to their original state. When the force of the air pressure in the cap 50 is decreased to be less than the pressing force of the springs 55, the cap 50 is pressed upward by the springs 55. The lip 54 then contacts the ink discharge surface 30*a*, and the ink discharge surface 30*a* is capped again with the cap 50. At this time, the side surfaces 51*g* are moved parallel with the side surfaces 62*a*, and the projections 51*c* are moved along the grooves 64*a*. Therefore, the cap 50 is moved stably in the direction perpendicular to the ink discharge surface 30*a*. When the air pressure in the cap 50 substantially increases, the variation of the air pressure in the cap 50 is absorbed because a portion of the air inside the cap 50 flows out. Because the damper films 52 only need to deform sufficiently when the air pressure in the cap 50 decreases, the depth of the recesses 51*a* may be relatively shallow.

A variation of the air pressure in the cap 50 thus may be absorbed, which prevents the variation of the air pressure in the cap 50 from damaging ink menisci in the nozzles 8.

In the above-described embodiments, when the air pressure in a cap 50 decreases, the damper films 25 deform and are positioned adjacent to the ink discharge surface 30*a*, whereby the capacity of the cap 50 is decreased to increase the air pressure in the cap 50. In contrast, when the air pressure in a cap 50 increases, the damper films 52 deform and are positioned adjacent to the bottom surfaces of the recesses 51*a*, whereby the capacity of the cap 50 increases to decrease the air pressure in the cap 50. Moreover, because the force of the springs 55 that presses each cap 50 against the ink discharge surface 30*a* may be selected to be less than the product of the withstand pressure of ink menisci formed in the nozzles 8 and the area of that portion of the base member 51 which is enclosed by the lip 54, when the air pressure in a cap 50 substantially increases, the cap 50 is pushed by the air inside the cap 50, and thereby moves away from the ink discharge surface 30*a*. Consequently, a gap is temporarily formed between the lip 54 and the ink discharge surface 30*a*, air flows out through the gap, and the air pressure in the cap 50 is decreased. Because a variation of the air pressure in the cap 50 is absorbed in, the ink menisci in the nozzles 8 may not be damaged.

Figure 14A:
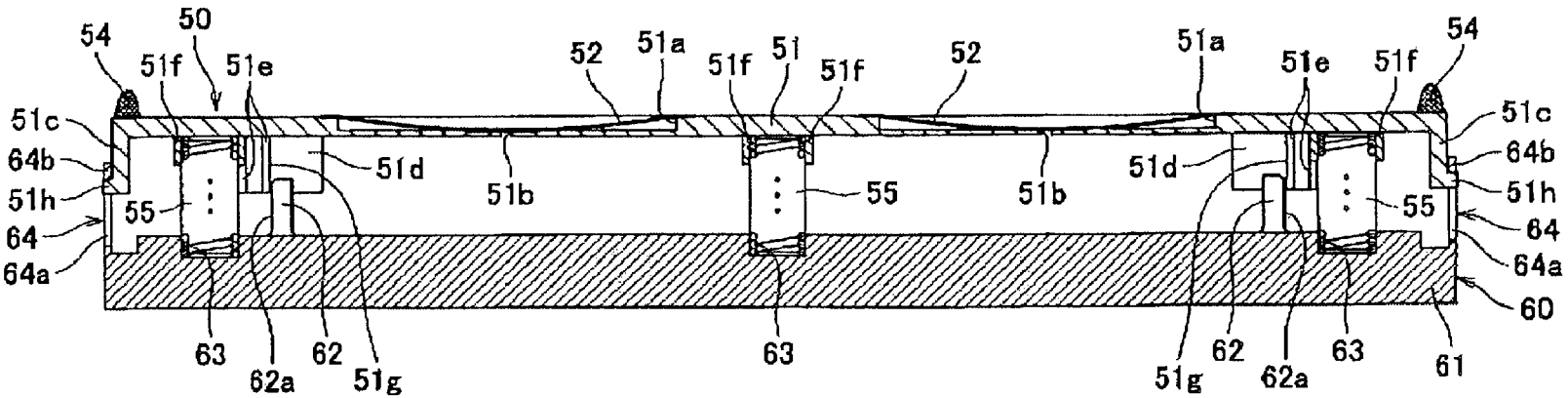
FIGS. 14A and 14B are sectional views of a cap and a cap holder according to another embodiment of the present invention.
Figure 14B:
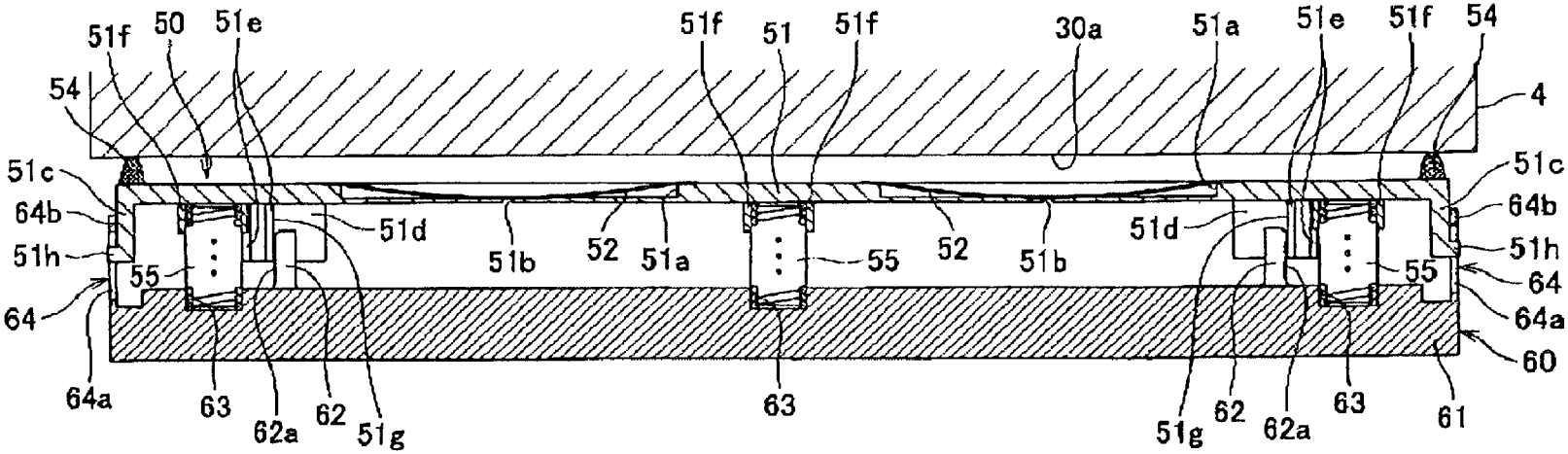

Referring to FIG. 14A in a modification of the above-described embodiments, the damper films 52 may contact the bottom surfaces of the recesses 51*a* when the ink discharge surface 30*a* is not capped with the cap 50. In this case, the maximum deformation of the damper films 52 toward the ink discharge surface 30*a* may be increased. Therefore, even when the air pressure in the cap 50 is substantially decreased when the ink discharge surface 30*a* is capped with the cap 50, the reduction of the air pressure may be absorbed. When the air pressure in the cap 50 increases, no large downward deformation may occur because the damper films 52 already are in contact with the bottom surfaces of the recesses 51*a*.

Figure 15:
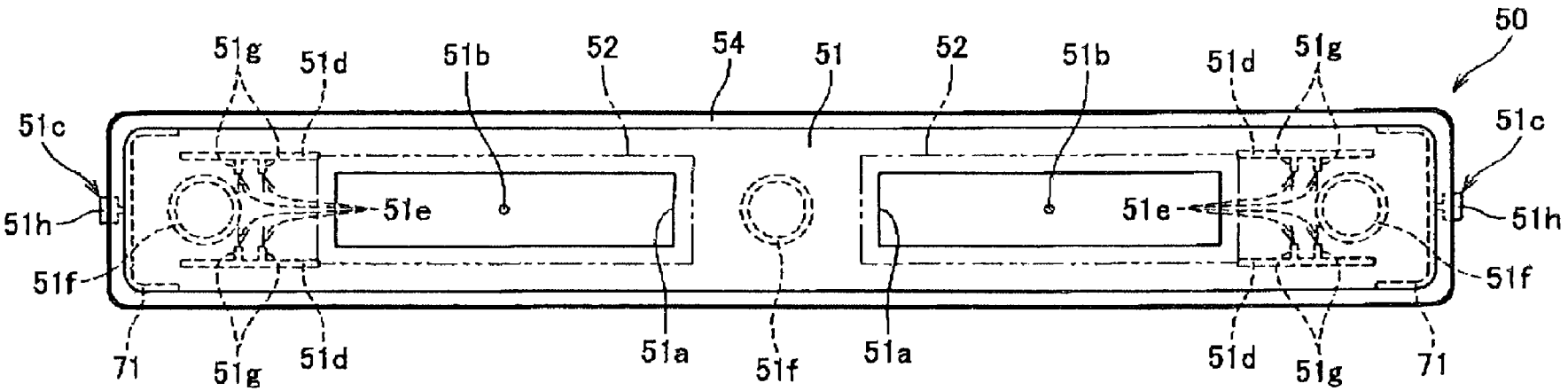
FIG. 15 is a plan view of a cap member according to yet another embodiment of the present invention.

Referring to FIG. 15, in another modification of the above-described embodiments, the bottom surface of the base member 51 of the cap 50 may comprise ribs 71 in regions which are adjacent to both end portions of the base member 51. The base member 51 may be deformed when pressed by the springs 55, and its deformation may be unstable in both end portions. Positioning the ribs 71 adjacent to both end portions of the base member 51 the unstable deformation in both end portions to be suppressed without obstructing its deformation in a central portion.

Figure 16:
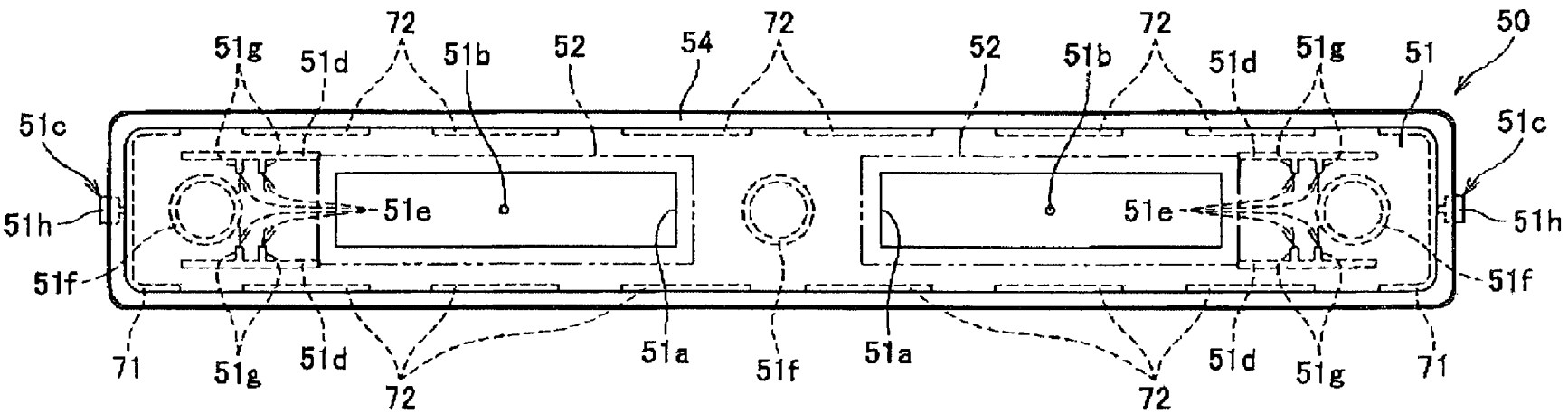
FIG. 16 is a plan view of a cap member according to still yet another embodiment of the present invention.

Referring to FIG. 16 in yet another modification of the above-described embodiments, the bottom surface of the base member 51 of the cap 50 may comprise ribs 71 and a plurality of ribs 72 which are positioned adjacent to both end portions of the base member 51, so as to be distributed in the longitudinal direction of the base member 51. The plurality of ribs 72 may be arranged symmetrically with respect to the center lines of the base member 51, and may extend in the longitudinal and lateral directions of the base member 51. Consequently, the rigidity of the base member 51 may be increased. Moreover, because the plurality of ribs 72 are distributed in the longitudinal direction of the base member 51, deformation of the base member 51 may not be obstructed, and even if the base member 51 is warped, the lip 54 may sufficiently contact the ink discharge surface 30*a* without increasing the force of pressing the cap 50.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the flowing claims.

What is claimed is:

1. An ink-jet recording apparatus comprising:

an ink-jet head comprising:

nozzles which are configured to discharge ink droplets; and an ink discharge surface which has ink discharge apertures of the nozzles formed therethrough;

a cap configured to cover the ink discharge surface, wherein the cap comprises:

a base member which opposes the ink discharge surface, wherein the base member has a recess formed therein, and the recess has a communication hole formed therethrough;

a damper film which is connected to the base member at an outer periphery of the recess and covers the recess; and a lip which is formed along an outer periphery of the base member and is configured to selectively contact the ink discharge surface; and a cap holder which is connected to the cap and is configured to selectively apply a force to the cap toward the ink discharge surface.

2. The ink-jet recording apparatus of claim 1, wherein the damper film is configured to be selectively disposed within the recess and positioned outside the recess based on a pressure within the recess.

3. The ink-jet recording apparatus of claim 1, wherein the damper film bends toward a bottom surface of the recess when the lip is separated from the ink discharge surface.

4. The ink-jet recording apparatus of claim 3, wherein the damper film contacts the bottom surface of the recess when the lip is separated from the ink discharge surface.

5. The ink-jet recording apparatus of claim 1, wherein the base member comprise a plurality of ribs which extend from the base member.

6. The ink-jet recording apparatus of claim 5, wherein the plurality of ribs are positioned adjacent to end portions of the base member.

7. The ink-jet recording apparatus of claim 5, further comprising a plurality of elastic members disposed between the plurality of ribs and the cap holder, wherein the plurality of elastic members urge the cap toward the ink-jet head when the lip contacts the ink discharge surface.

8. The ink-jet recording apparatus of claim 7, wherein the plurality of ribs comprise positioning surfaces which extend perpendicularly to the ink discharge surface and oppose the cap holder when the lip is separated from the ink discharge surface.

9. A cap comprising: a base member which has a recess formed therein, wherein the recess has a communication hole formed therethrough; a damper film which is connected to the base member at an outer periphery of the recess and covers the recess; and a lip which is formed along an outer periphery of the base member.

10. The cap of claim 9, wherein the damper film is configured to be selectively disposed within the recess and positioned outside the recess based on a pressure within the recess.

* * * * *